US006511155B1

(12) United States Patent
Fassler et al.

(10) Patent No.: US 6,511,155 B1
(45) Date of Patent: Jan. 28, 2003

(54) CLEANING INK JET PRINTHEADS AND ORIFICES

(75) Inventors: Werner Fassler, Rochester, NY (US); Marcello Fiscella, Fairport, NY (US); David A. Bartman, Webster, NY (US); John Meyers, Lakeville, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/935,495

(22) Filed: Aug. 23, 2001

(51) Int. Cl.[7] ..... B41J 2/165
(52) U.S. Cl. ..... 347/35; 347/28
(58) Field of Search ..... 347/28, 22, 25, 347/27, 29, 30, 32, 35

(56) References Cited

U.S. PATENT DOCUMENTS 6,047,715 A 4/2000 Mooney et al. ..... 134/122 R

*Primary Examiner*—Shih-Wen Hsieh
(74) *Attorney, Agent, or Firm*—David J. Arthur

(57) ABSTRACT

Cleaning apparatus for cleaning debris from orifices in an ink jet printhead nozzle plate includes a structure defining a cleaning cavity between two horizontally contacting rollers where cleaning liquid is loaded, agitated, and dynamically sealed in the cavity trough the rotation of the rollers. A relative movement is also provided between the nozzle plate and the cleaning structure so that the nozzle plate can be positioned above the cleaning cavity with the rotating rollers. The nozzle plate is spaced a small distance from the flow of the cleaning liquid that the cleaning fluid fills this small distance. The flow causes the cleaning fluid to engage the nozzle plate and remove debris from the nozzle plate and orifice nozzles. After the cleaning cycle has ended the cleaning fluid is discarded.

20 Claims, 4 Drawing Sheets

CLEANING INK JET PRINTHEADS AND ORIFICES

BACKGROUND OF THE INVENTION

This invention relates to cleaning debris from orifices in an ink jet printhead nozzle plate.

Many different types of digitally controlled printing systems of ink jet printing apparatus are presently being used. These ink jet printers use a variety of actuation mechanisms, a variety of marking materials, and a variety of recording media. For home applications, digital ink jet printing apparatus is the printing system of choice because low hardware cost makes the printer widely affordable. Another application for digital ink jet printing uses large format printers. These large format printers are expected to provide low cost copies with an ever improving quality. Ink jet printing technology is the first choice in today's art. Thus, there is a need for improved ways to make digitally controlled graphic arts media, such as billboards, large displays, and home photos, for example, so that quality color images may be made at a high-speed and low cost, using standard or special paper.

Ink jet printing has become recognized as a prominent contender in the digitally controlled, electronic printing arena because of its non impact, low-noise characteristics, its use of papers from plain paper to specialized high gloss papers and its avoidance of toner transfers and fixing. Ink jet printing mechanisms can be categorized as either continuous ink jet or droplet on demand ink jet.

Continuous ink jet printing generally involves using electric charge to selectively direct a stream of ink droplets. On demand type ink jet printers selectively produce individual ink droplets at each of many ink jet orifices. A typical consumer type printer includes approximately 30 to 200 orifices on the nozzle plate. At every orifice, a pressurization actuator is used to produce the ink jet droplet. Typical on demand ink jet printers use one of two types of actuators to produce the ink jet droplet. The two types of actuators are heat and piezo materials. With a heat actuator, a heater at a convenient location heats ink and a quantity of the ink will phase change into a gaseous steam bubble and raise the internal ink pressure sufficiently for an ink droplet to be expelled to a suitable receiver. The piezo ink actuator incorporates a piezo material. Material is said to possess piezo electric properties if an electric charge is produced when a mechanical stress is applied. This is commonly referred to as the "generator effect." The converse also holds true, in that an applied electric field will produce a mechanical stress in the material. This is commonly referred to as the "motor effect."

Inks for high speed jet droplet printers have a number of special characteristics. Typically, water-based inks have been used because of their conductivity and viscosity range. For use in a jet droplet printer, preferred inks are electrically conductive, having a resistivity below about 5000 ohm-cm and preferably below about 500 ohm-cm. For good flow through small orifices, water-based inks generally have a viscosity in the range between about 1 to 15 centipoise at 25 degree C. Preferred inks additionally are stable over a long period of time, compatible with the materials comprising the nozzle plate and ink manifold, free of living organisms, and functional after printing. Preferred after printing characteristics are smear resistance after printing, fast drying on paper, and waterproof when dry. An ideal ink also incorporates a nondrying characteristic in the jet cavity so that the drying of ink in the cavity is hindered or slowed to such a degree that through occasional spitting of ink droplets the cavities can be kept open. The addition of glycol will facilitate the free flow of ink through the ink jet. Also it is of benefit if ink additives prevent the ink from sticking to the ink jet printhead surfaces.

Ink jet printing apparatus typically includes an ink jet printhead that is exposed to the various environment where ink jet printing is utilized. The orifices are exposed to all kinds of air borne particles. Particulate debris accumulates on the printhead surfaces, forming around the orifices. The ink may combine with such particulate debris to form an interference burr to block the orifice or cause through an altered surface wetting to inhibit a proper formation of the ink droplet. That particulate debris has to be cleaned from the orifice to restore proper droplet formation. This cleaning commonly is achieved by wiping, spraying, vacuum suction, and/or spitting of ink through the orifice. The wiping is the most common application.

SUMMARY OF THE INVENTION

The present invention provides improved cleaning of the nozzle plate of an ink jet printhead. The invention provides an ink jet printing apparatus wherein the cleaning liquid can be effectively used to provide for improved cleaning with a minimum number of parts and operations. The present invention provides for non-contacting cleaning of particulate debris, thereby eliminating the need of traditional wiper blades or other mechanical contact methods. This invention also permits use and disposal of a defined quantity of cleaning fluid for each printhead and each cleaning cycle, providing fresh cleaning fluid for each cleaning operation, and eliminating the need for multiple cleaning stations.

A pair of rollers have substantially parallel axes of rotation. The outer surfaces of the rollers contact one another along a substantially horizontal contact line, forming above the contact line a roller cavity. A dispenser dispenses a predetermined amount of cleaning fluid into the roller cavity. A drive mechanism connected to at least one of the rollers rotates the roller about its axis of rotation. The rollers are operatively connected so that as one rotates in one direction, the other rotates in the opposite direction. The drive mechanism is capable of rotating one of the rollers in a first direction, so that the second roller rotates in the opposite direction, to tend to retain the cleaning fluid in the roller cavity, and agitate the cleaning fluid. The printhead orifice plate can then be brought into contact with the agitated cleaning fluid (but not the rollers themselves). After the cleaning fluid has cleaned the orifice plate, the drive mechanism reverses the rotation of the rollers to remove the cleaning fluid from the roller cavity.

DETAILED DESCRIPTION OF THE DRAWING

Figure 1:
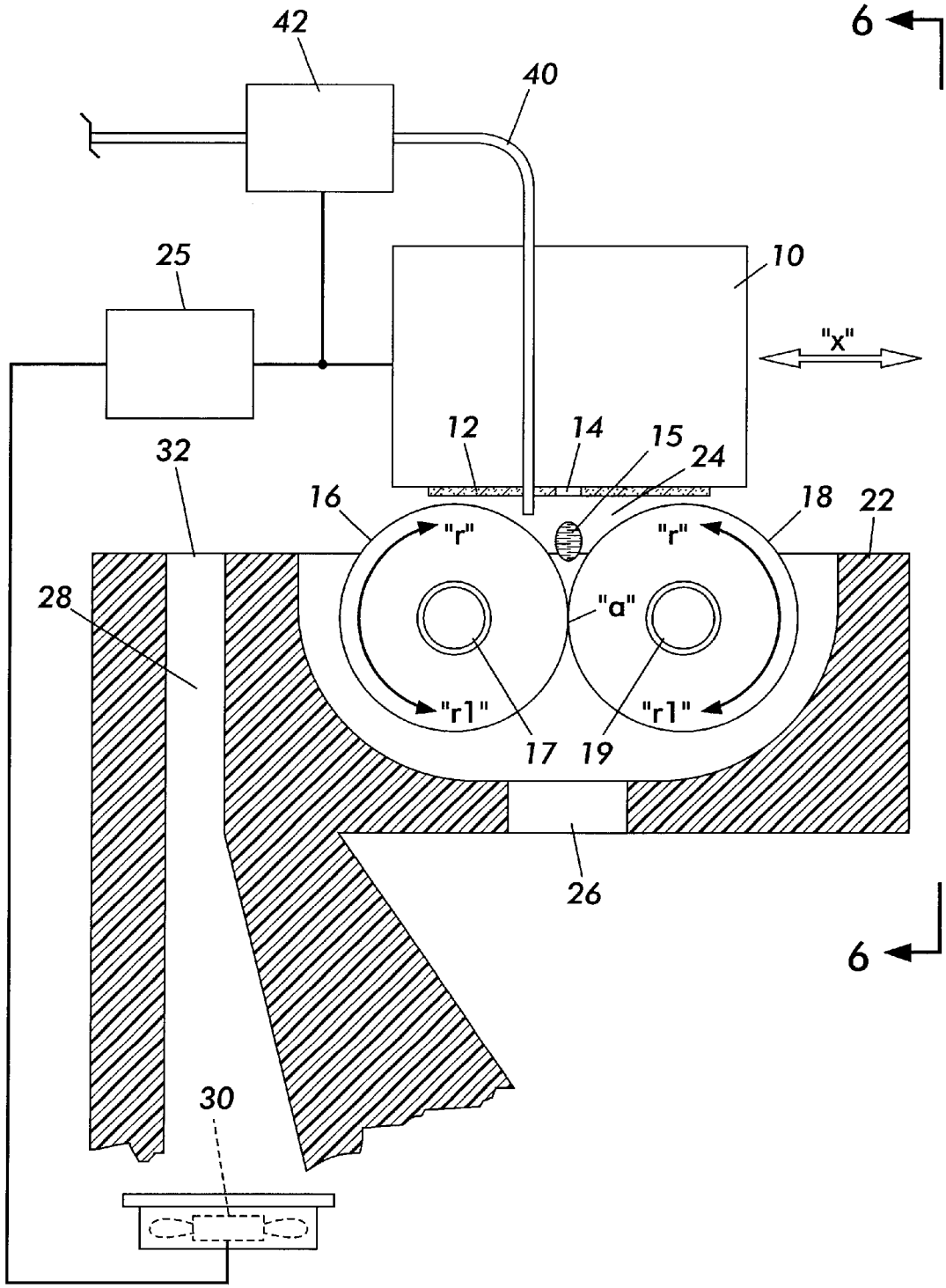
FIG. 1 shows one embodiment of an ink jet printer cleaning station in accordance with an aspect of the present invention.

Turning first to FIG. 1, there is shown a cross sectional view of a cleaning station of an ink jet printer. The printer includes a printhead 10 with a nozzle plate 12. Many orifices 14 (only one of which is shown) extend through the nozzle plate 12. The printhead 10 includes a manifold and capillary tubes (not shown) for delivering ink to each orifice 14. The printhead selectively ejects droplets of ink 15 from the orifices 14. The construction of such ink jet printheads is well understood by persons familiar with the art.

The cleaning station includes two cleaning rollers 16, 18. The cleaning rollers each have an axle 17, 19 that coincides with the cleaning roller's axis of rotation. The ends of each axle are rotationally mounted to a cleaning station housing structure 22 (see FIG. 6). In the implementation illustrated in FIG. 1, the cleaning rollers 16, 18 are substantially cylindrical, and have the same diameter as one another. The axes of rotation of the cleaning rollers are preferably parallel to one another and horizontal. The surfaces of the cleaning rollers 16, 18 contact each other at a contact point "a" to form a contact. The two cleaning rollers form a roller cavity 24 above the roller contact point "a". This roller cavity extends along the length of the cleaning rollers. The cleaning rollers are preferably of the same length, though they may have different lengths. The roller cavity 24 exists along the common length of the contact point "a" between the two cleaning rollers.

The cleaning rollers 16, 18 may be formed of any material that is compatible with the cleaning solutions to be used in cleaning the printhead. Suitable materials that do not significantly deteriorate in the presence of many cleaning fluids include anodized aluminum, and certain hard rubbers and plastics.

The cleaning station of the illustrated embodiment is oriented so that the printhead 10 traverses across the cleaning station in the direction "x". The direction of travel for the printhead is substantially perpendicular to the axes of the two cleaning rollers 16, 18, and substantially parallel to a plane that includes the rotation axes of the two cleaning rollers. The cleaning station is further preferably oriented so that the nozzle plate 12 is substantially parallel the plane of the rotation axes of the cleaning rollers. A printer controller 25 controls the movement of the printhead 10 in the printer.

The housing 22 surrounds the cleaning rollers to help contain the cleaning fluid during and after a cleaning operation, and to direct waste cleaning fluid to a drain 26. A suction funnel 28 adjacent the housing for the cleaning rollers allows a fan 30 to draw excess fluid from the printhead, and from the face of the nozzle plate 12 in particular. The suction funnel 28 has an inlet opening 32 near the path of the nozzle plate on the printhead. For example, the suction funnel inlet opening 32 may be approximately in the same plane as the tops of the cleaning rollers 16, 18, or slightly below the tops of the cleaning rollers. The suction funnel 28 is integrally formed with the housing 22.

Figure 6:
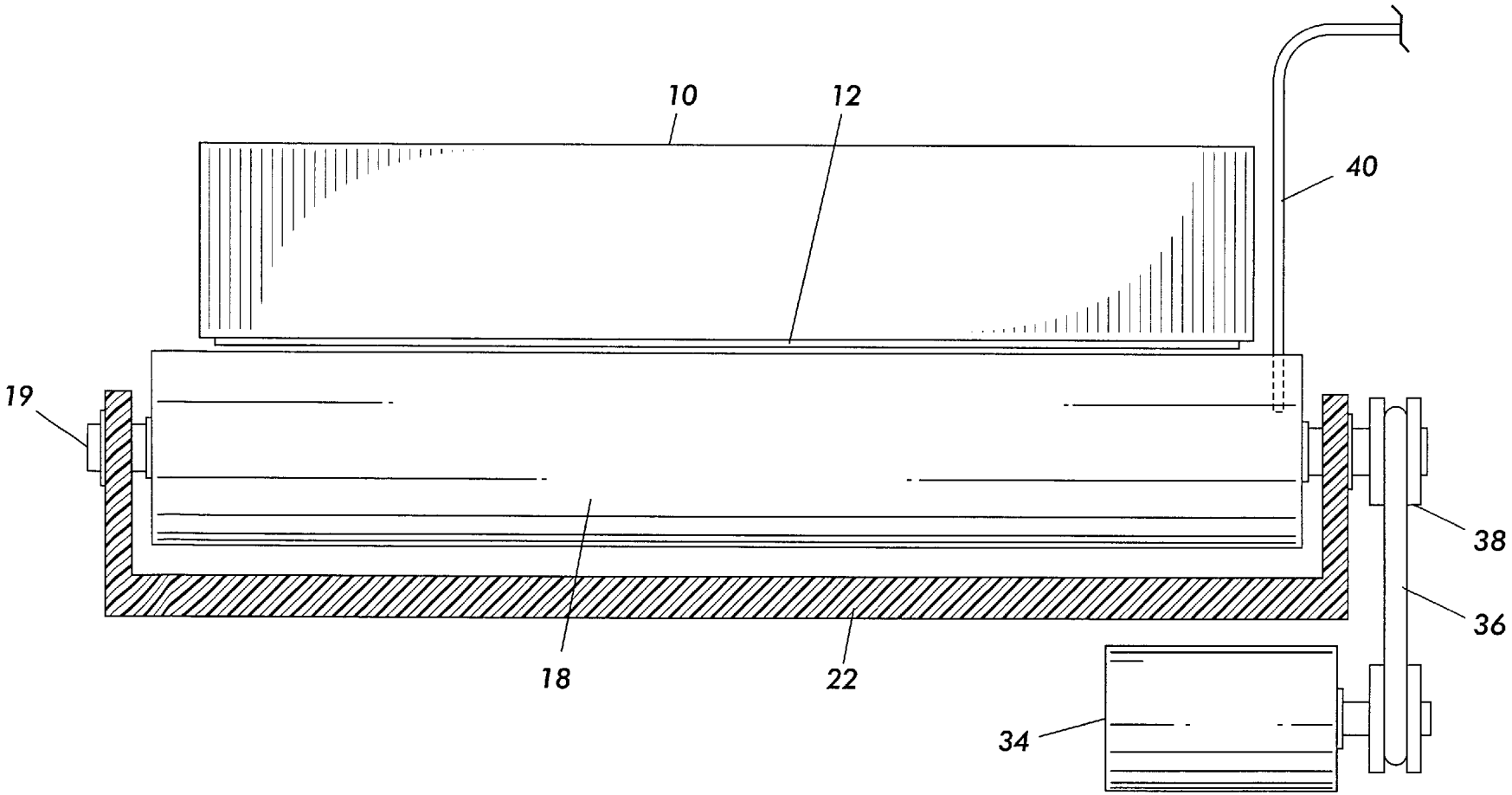
FIG. 6 is a side view of the cleaning station embodiment of FIG. 1.

Referring now to FIG. 6, a drive mechanism, such as an electric motor 34, rotates the cleaning rollers 16, 18. The drive mechanism may be connected directly to the cleaning roller, or it may be connected as shown through a drive belt 36 and a pulley 38 attached to the axle 19 of the cleaning roller 18. The other cleaning roller 16 (FIG. 1) is spring mounted to hold that cleaning roller 16 in contact with the driven cleaning roller 18. This other cleaning roller 16 may freely rotate about its axis of rotation, or it may also be rotationally driven. When the motor 34 rotates the roller 18 in one direction, the other roller 16 is rotated in the opposite direction. Those skilled in the art will recognize that other types of mechanisms can connect the motor 34 and the cleaning roller 18. For example, a friction or gear connection may be supplied between the motor and either the axle 19, or a portion of the outer surface of the roller 18.

A diagram including an inlet tube 40 delivers cleaning fluid into the roller cavity 24 (see FIG. 1). A fluid delivery controller 42 delivers a predetermined amount of cleaning or other maintenance fluid through the inlet tube 40 to the roller cavity 24. Many types of cleaning fluid are well known to persons familiar with the art. For example, cleaning fluid may be the same as an ink base without dye or pigment.

Figure 2:
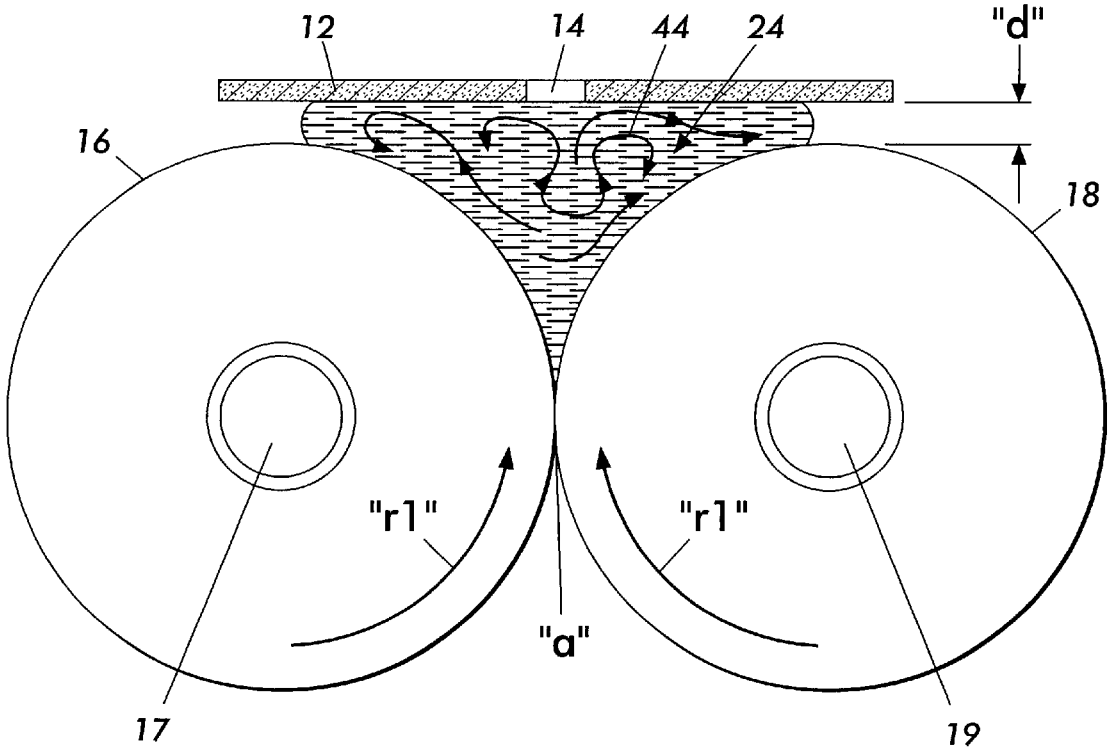
FIG. 2 shows an enlargement of the cleaning rollers of FIG. 1.

For a cleaning operation, the fluid delivery controller 42 dispenses a predetermined quantity of cleaning fluid 44 into the roller cavity 24 (see FIG. 2). The quantity may be approximately enough to fill the roller cavity 24 to the tops of the cleaning rollers 16, 18. The cleaning rollers are rotated in opposite directions (indicated in FIG. 1 by the arrows "r") to agitate the cleaning fluid in the roller cavity 24 while retaining the cleaning fluid in the roller cavity above the contact point "a." The quantity of cleaning fluid in the roller cavity is selected to be sufficient that as the cleaning rollers 16, 18 agitate the cleaning fluid 44, the agitated cleaning fluid rises to at least the level of the nozzle plate 12. The rotation of the cleaning rollers dynamically seals the cleaning fluid 44 in the roller cavity 24. The drive mechanism 34 rotates the cleaning rollers 16, 18 at approximately 50–200 rpm, though other speeds also provide appropriate function.

The printer controller 25 moves the printhead 10 over the cleaning station as the cleaning rollers 16, 18 agitate the cleaning fluid so that the nozzle plate 12 on the printhead comes into contact with the agitated cleaning fluid 44. The cleaning fluid 44 is thereby able to clean debris from the surface of the nozzle plate 12, and from the orifices 14 of the nozzle plate. By using the agitated cleaning fluid to clean the orifices 14, it is generally not necessary to eject ink through the orifices as part of the cleaning operation, thereby saving ink. Nevertheless, in certain circumstances, ejecting ink droplets from the orifices during a cleaning operation may supplement the cleaning action of the agitated cleaning fluid. The agitated cleaning fluid efficiently cleans the nozzle plate and nozzles quickly, and without mechanical rubbing that may damage the nozzle plate. Individual inks can be cleaned with different agitation by selecting different rotations for the cleaning rollers. The speed and/or roller geometry can be selected to match the cleaning needs of a particular ink. In other words, different color inks (such as red, green, and blue inks in the same cartridge), or different types of inks (such as dye based or pigment based, or such as aqueous or oil based) can have different cleaning actions.

FIG. 2 shows the cleaning cavity 24 in an enlargement to clarify the cleaning action of the cleaning rollers 16, 18, and the agitation of the cleaning liquid 44. The cleaning rollers 16, 18 rotate as the printhead with the nozzle plate 12 is moved into the cleaning station so that the agitated cleaning liquid 44 contacts the orifice nozzle plate 12. The cleaning liquid is held in the cavity space 24 by the rotation "r" (shown in FIG. 1) of the two rollers 16, 18. When the printhead orifice nozzle plate 12 is in operative relationship with the rotating cleaning roller 16, 18, the cleaning rollers 16, 18 are spaced from the orifice nozzle plate 12 a distance shown as "d" so that there is turbulence of the cleaning liquid 44 to cause the cleaning liquid to engage the orifice nozzle plate 12. Such turbulence causes the cleaning of the ink jet outlet orifices 14, and the orifice nozzle plate 12 and in addition it leaves a clearance "d" so that there is no hard contact between the cleaning rollers 16, 18 and the nozzle plate 12.

After the printhead has passed over the cleaning station, the rotational direction of the cleaning rollers 16, 18 is reversed so that they rotate in the direction indicated "r1" in FIG. 1. This reversed rotation draws the cleaning fluid 44 out of the roller cavity 24, and allows the cleaning fluid to exit the cleaning station through the drain 26. The cleaning fluid is then discarded. Using fresh cleaning fluid for each cleaning operation keeps particulate debris and waste ink from contaminating the nozzle plate, and allows one cleaning station to be used to clean multiple color printheads. The quantity of cleaning fluid used for each cleaning operation is small, so that using each batch only once is economical.

The printhead is then moved across the inlet opening 32 of the suction funnel 28 as the fan 30 is activated, to draw cleaning fluid and ink residue from the nozzle plate 12, drying the nozzle plate.

Figure 3:
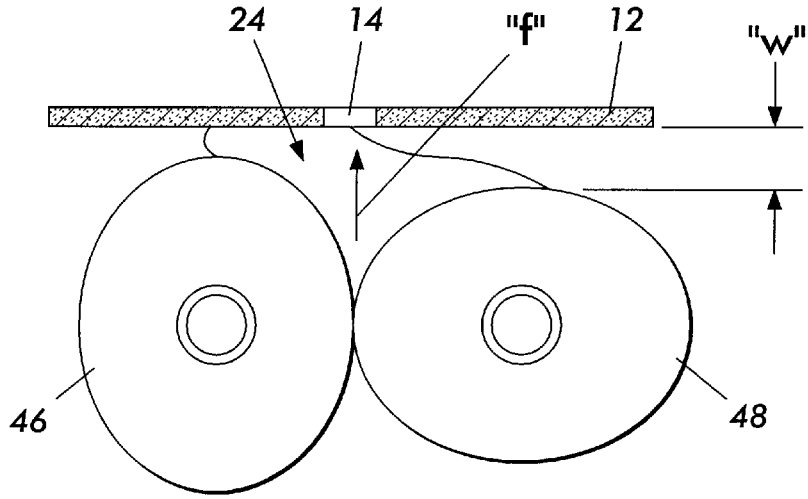
FIG. 3 shows a second embodiment of the two rotating cleaning rollers.

FIG. 3 shows an alternative embodiment with two eccentric rollers 46, 48 instead of the cylindrical rollers 16, 18 of the embodiment shown in FIGS. 1, 2, and 6. The eccentric rollers may have elliptical cross sections. The cross sectional shapes of the eccentric rollers 46, 48 and their relative orientations and positions are arranged so that as the rollers rotate, their surfaces remain in contact to preserve the roller cavity 24. As the eccentric rollers 46, 48 rotate, the upper surface of each roller (nearest the nozzle plate 12) raises and lowers by an amount labeled "w." The raising and lowering of the roller surface during a cleaning operation causes cleaning fluid in the roller cavity 24 to have different flow patterns. As is indicated with flow lines "f" in FIG. 3, an upward thrusting flow of cleaning fluid is created to clean the orifice nozzle plate 12. The fluid pressure in the roller cavity 24 is altered by this pulsating effect of the eccentric rollers 46, 48 to create pressure waves in the fluid.

As an alternative, cylindrical rollers can have their rotational axes offset from the central axis of the cylinder.

Figure 4:
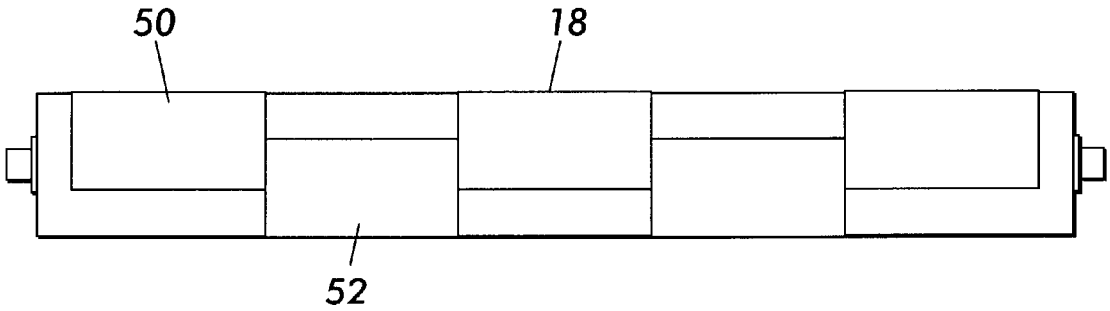
FIG. 4 shows an embodiment of one of the cleaning rollers with hydrophobic and hydrophilic surface patches.
Figure 5:
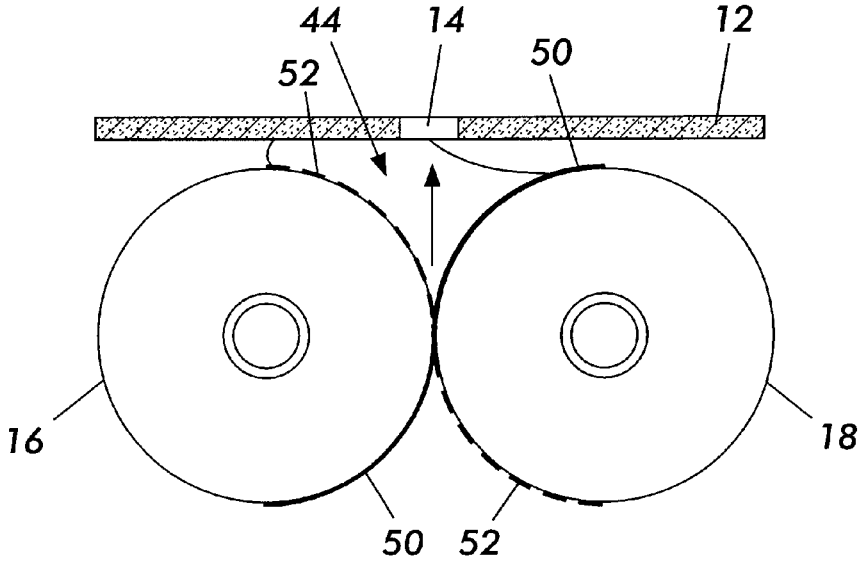
FIG. 5 shows the cleaning rollers with hydrophobic and hydrophilic patches in interaction.

FIGS. 4 and 5 shows how altered surface characteristics can enhance the operation of the cleaning rollers 16, 18 by enhancing turbulence in the cleaning fluid in the roller cavity. The surfaces of the cleaning rollers 16, 18 shown are coated to provide alternating sections of hydrophobic surface texture 50 and hydrophilic surface texture 52. Rotating the cleaning rollers with these alternating hydrophobic and hydrophilic surfaces will alter the flow of the cleaning liquid 4. As seen in FIG. 5, the cleaning rollers are arranged so that when the hydrophilic surface 52 of one cleaning roller 16 faces into the roller cavity 24, the hydrophobic surface 50 of the other cleaning roller 18 faces into the roller cavity 24. Then as the cleaning rollers 16, 18 rotate, the hydrophobic surface 50 of the first cleaning roller 16 faces into the roller cavity 24, and the hydrophilic surface 52 of the second cleaning roller 18 faces into the roller cavity 24. This alternating presentation of the hydrophilic and hydrophobic surfaces to the cleaning fluid 44 in the roller cavity 24 enhances the agitation of the cleaning fluid 44 in the roller cavity 24.

Those skilled in the art will identify various modifications that can be made to the particular implementations described above that nevertheless remain within the spirit of the invention. For example, other shapes and surfaces for the rollers may be used, as can other types of roller mountings, drive mechanisms, and housings. Therefore, the above descriptions are illustrative only.

We claim:

1. An ink jet printer comprising:

an ink jet printhead having an orifice plate;

a cleaning station, the cleaning station comprising:

a cleaning station housing;

first and second rollers, wherein:

the first and second rollers have substantially parallel, horizontal axes of rotation;

outer surfaces of the first and second rollers contact one another along a substantially horizontal contact line to form above the contact line a roller cavity;

a dispenser for dispensing cleaning fluid into the roller cavity;

a drive mechanism connected to the first roller for rotating the first roller about its axis of rotation, wherein:

as the drive mechanism rotates the first roller in one direction, the second roller is rotated in the opposite direction;

the drive mechanism is capable of rotating the first roller in a first direction so that the second roller rotates in a second direction that tends to retain the fluid in the roller cavity; and the drive mechanism is additionally capable of rotating the first roller in the second direction so that the second roller rotates in the first direction that tends to remove the fluid from the roller cavity; and a printer controller connected to the printhead for moving the printhead to a position at the cleaning station in which the orifice plate is substantially parallel to the axes of rotation of the first and second rollers, and spaced slightly above the first and second rollers.

2. The ink jet printer of claim 1, wherein each of the rollers of the cleaning station is substantially cylindrical.

3. The ink jet printer of claim 1 wherein each of the rollers has an eccentric cross section.

4. The ink jet printer of claim 1, wherein the surface of at least one of the rollers is configured to enhance turbulence of cleaning fluid in the roller cavity as the drive mechanism rotates the first roller in the first direction.

5. The ink jet printer of claim 1, wherein the cleaning station additionally comprises:

a funnel for directing a gas flow across the orifice plate; and a fan for directing air through the funnel.

6. Apparatus for cleaning an orifice plate, the cleaning apparatus comprising:

a pair of rollers having substantially parallel axes of rotation, wherein outer surfaces of the rollers contact one another along a contact line to form above the contact line a roller cavity;

a dispenser for dispensing cleaning fluid into the roller cavity;

a drive mechanism connected to at least one of the rollers for rotating the at least one roller about its axis of rotation, wherein:

the drive mechanism is capable of rotating the roller in a first direction that tends to retain the fluid in the roller cavity.

7. The cleaning apparatus of claim 6, wherein the drive mechanism additionally is capable of moving at least one of the rollers to remove the fluid from the roller cavity.

8. The cleaning apparatus of claim 6, wherein the drive mechanism additionally is capable of rotating the roller in a second direction that tends to remove the fluid from the roller cavity.

9. The cleaning apparatus of claim 6, wherein each of the rollers is substantially cylindrical.

10. The cleaning apparatus of claim 6 wherein each of the rollers has an eccentric cross section.

11. The cleaning apparatus of claim 6, wherein the surface of at least one of the rollers is configured to enhance turbulence of cleaning fluid in the roller cavity as the drive mechanism rotates the first roller in the first direction.

12. The cleaning apparatus of claim 11, wherein:

a first portion of the surface of at least one of the rollers is hydrophobic; and a second portion of the surface of at least one of the rollers is hydrophilic.

13. The cleaning apparatus of claim 6, additionally comprising a funnel for directing a gas flow across the orifice plate.

14. The cleaning apparatus of claim 13, additionally comprising a fan for directing air through the funnel.

15. A method of cleaning an ink jet printhead orifice plate, the method comprising:

rotating a pair of rollers against one another to form a roller cavity above a point at which the rollers contact one another;

supplying cleaning fluid to the roller cavity;

continuing to rotate the pair of rollers;

moving the rollers and the printhead orifice plate relative to one another to bring the printhead orifice plate and the cleaning fluid into contact with one another; and removing the cleaning fluid from the roller cavity.

16. The method of claim 15, wherein the step of removing the cleaning fluid from the roller cavity comprises reversing the rotation of the rollers.

17. The method of claim 15, additionally comprising discarding the cleaning fluid removed from the roller cavity after each time the cleaning fluid is removed from the roller cavity, without resupplying that cleaning fluid to the roller cavity.

18. The method of claim 15, additionally comprising directing a flow of air across the orifice plate.

19. The method of claim 15, additionally comprising agitating the cleaning fluid in the roller cavity.

20. The method of claim 19, wherein the step of agitating the cleaning fluid in the roller cavity comprises:

rotating a first roller in a first rotational direction;

rotating a second roller in a second rotational direction, opposite the first rotational direction; and rotating the first and second rollers in a manner that enhances turbulence of the fluid in the roller cavity.

* * * * *